US010902703B1

(12) United States Patent
Klimoski

(10) Patent No.: US 10,902,703 B1
(45) Date of Patent: Jan. 26, 2021

(54) OUTCOME VARIATION FOR GRID BASED NUMBER SELECTION GAMES

(71) Applicant: David Bruce Klimoski, Reno, NV (US)

(72) Inventor: David Bruce Klimoski, Reno, NV (US)

( * ) Notice: Subject to any disclaimer, the term of this patent is extended or adjusted under 35 U.S.C. 154(b) by 68 days.

(21) Appl. No.: 16/046,048

(22) Filed: Jul. 26, 2018

Related U.S. Application Data

(60) Provisional application No. 62/540,211, filed on Aug. 2, 2017.

(51) Int. Cl.
*G07F 17/32* (2006.01)
*A63F 3/06* (2006.01)

(52) U.S. Cl.
CPC ..... *G07F 17/329* (2013.01); *A63F 3/061* (2013.01); *A63F 3/062* (2013.01); *G07F 17/3262* (2013.01); *G07F 17/3209* (2013.01); *G07F 17/3211* (2013.01)

(58) Field of Classification Search
CPC ..... G07F 17/3209; G07F 17/3211; G07F 17/3262; G07F 17/329
USPC ..... 273/269
See application file for complete search history.

(56) References Cited

U.S. PATENT DOCUMENTS

| | | | | |
|---|---|---|---|---|
| 5,813,911 | A * | 9/1998 | Margolin | A63F 3/0645 463/19 |
| 6,783,456 | B2 | 8/2004 | White | |
| 8,333,648 | B2 | 12/2012 | Tarantino | |
| 8,480,472 | B2 * | 7/2013 | Seaton | G07F 17/3244 273/269 |
| 8,579,699 | B2 | 11/2013 | Bigelow, Jr. et al. | |
| 9,430,917 | B2 | 8/2016 | Aponte et al. | |
| 9,495,842 | B2 | 11/2016 | Bigelow, Jr. et al. | |
| 2002/0058544 | A1 * | 5/2002 | Perrie | A63F 3/00075 463/16 |
| 2009/0325682 | A1 | 12/2009 | Barney et al. | |

* cited by examiner

*Primary Examiner* — John E Simms, Jr.
*Assistant Examiner* — Rayshun K Peng
(74) *Attorney, Agent, or Firm* — Goldstein Law Offices, P.C.

(57) ABSTRACT

A method for providing outcome variation for grid based number selection games is disclosed. The method allows novel interactions with random populations of numbers referenced on a grid which can be implemented as enhancements to existing grid based number selection games or as a standalone game, where the interaction involves placing one or more bets to predict the occurrences of combinations of a defined configuration that can be formed on a grid using a random number population. These bets can be implemented as side bets for an existing game in order to introduce new player strategies and reward options without disrupting the mechanics of the underlying game.

20 Claims, 15 Drawing Sheets

302 301

| | | | | | | | | | |
|---|---|---|---|---|---|---|---|---|---|
| 1 | 2 | 3 | 4 | 5 | 6 | 7 | 8 | 9 | 10 |
| 11 | 12 | 13 | 14 | 15 | 16 | 17 | 18 | 19 | 20 |
| 21 | 22 | 23 | 24 | 25 | 26 | 27 | 28 | 29 | 30 |
| 31 | 32 | 33 | 34 | 35 | 36 | 37 | 38 | 39 | 40 |
| | | | | | | | | | |
| 41 | 42 | 43 | 44 | 45 | 46 | 47 | 48 | 49 | 50 |
| 51 | 52 | 53 | 54 | 55 | 56 | 57 | 58 | 59 | 60 |
| 61 | 62 | 63 | 64 | 65 | 66 | 67 | 68 | 69 | 70 |
| 71 | 72 | 73 | 74 | 75 | 76 | 77 | 78 | 79 | 80 |

*FIG. 3*

501

| | | | | | | | | | |
|---|---|---|---|---|---|---|---|---|---|
| 1 | 2 | 3 | 4 | 5 | 6 | 7 | 8 | 9 | 10 |
| 11 | 12 | 13 | 14 | 15 | 16 | 17 | 18 | 19 | 20 |
| 21 | 22 | 23 | 24 | 25 | 26 | 27 | 28 | 29 | 30 |
| 31 | 32 | 33 | 34 | 35 | 36 | 37 | 38 | 39 | 40 |
| | | | | | | | | | |
| 41 | 42 | 43 | 44 | 45 | 46 | 47 | 48 | 49 | 50 |
| 51 | 52 | 53 | 54 | 55 | 56 | 57 | 58 | 59 | 60 |
| 61 | 62 | 63 | 64 | 65 | 66 | 67 | 68 | 69 | 70 |
| 71 | 72 | 73 | 74 | 75 | 76 | 77 | 78 | 79 | 80 |

*FIG. 5*

| | | | | | | | | | |
|---|---|---|---|---|---|---|---|---|---|
| 1 | 2 | 3 | 4 | 5 | 6 | 7 | 8 | 9 | 10 |
| 11 | 12 | 13 | 14 | 15 | 16 | 17 | 18 | 19 | 20 |
| 21 | 22 | 23 | 24 | 25 | 26 | 27 | 28 | 29 | 30 |
| 31 | 32 | 33 | 34 | 35 | 36 | 37 | 38 | 39 | 40 |
| | | | | | | | | | |
| 41 | 42 | 43 | 44 | 45 | 46 | 47 | 48 | 49 | 50 |
| 51 | 52 | 53 | 54 | 55 | 56 | 57 | 58 | 59 | 60 |
| 61 | 62 | 63 | 64 | 65 | 66 | 67 | 68 | 69 | 70 |
| 71 | 72 | 73 | 74 | 75 | 76 | 77 | 78 | 79 | 80 |

601

*FIG. 6*

| | | | | | | | | | |
|---|---|---|---|---|---|---|---|---|---|
| 1 | 2 | 3 | 4 | 5 | 6 | 7 | 8 | 9 | 10 |
| 11 | 12 | 13 | 14 | 15 | 16 | 17 | 18 | 19 | 20 |
| 21 | 22 | 23 | 24 | 25 | 26 | 27 | 28 | 29 | 30 |
| 31 | 32 | 33 | 34 | 35 | 36 | 37 | 38 | 39 | 40 |
| | | | | | | | | | |
| 41 | 42 | 43 | 44 | 45 | 46 | 47 | 48 | 49 | 50 |
| 51 | 52 | 53 | 54 | 55 | 56 | 57 | 58 | 59 | 60 |
| 61 | 62 | 63 | 64 | 65 | 66 | 67 | 68 | 69 | 70 |
| 71 | 72 | 73 | 74 | 75 | 76 | 77 | 78 | 79 | 80 |

701

*FIG. 7*

| | | | | | | | | | |
|---|---|---|---|---|---|---|---|---|---|
| 1 | 2 | 3 | 4 | 5 | 6 | 7 | 8 | 9 | 10 |
| 11 | 12 | 13 | 14 | 15 | 16 | 17 | 18 | 19 | 20 |
| 21 | 22 | 23 | 24 | 25 | 26 | 27 | 28 | 29 | 30 |
| 31 | 32 | 33 | 34 | 35 | 36 | 37 | 38 | 39 | 40 |
| | | | | | | | | | |
| 41 | 42 | 43 | 44 | 45 | 46 | 47 | 48 | 49 | 50 |
| 51 | 52 | 53 | 54 | 55 | 56 | 57 | 58 | 59 | 60 |
| 61 | 62 | 63 | 64 | 65 | 66 | 67 | 68 | 69 | 70 |
| 71 | 72 | 73 | 74 | 75 | 76 | 77 | 78 | 79 | 80 |

801

FIG. 8

1003

1001

| | | | | | | | | | |
|---|---|---|---|---|---|---|---|---|---|
| 1 | 2 | 3 | 4 | 5 | 6 | 7 | 8 | 9 | 10 |
| 11 | 12 | 13 | 14 | 15 | 16 | 17 | 18 | 19 | 20 |
| 21 | 22 | 23 | 24 | 25 | 26 | 27 | 28 | 29 | 30 |
| 31 | 32 | 33 | 34 | 35 | 36 | 37 | 38 | 39 | 40 |
| | | | | | | | | | |
| 41 | 42 | 43 | 44 | 45 | 46 | 47 | 48 | 49 | 50 |
| 51 | 52 | 53 | 54 | 55 | 56 | 57 | 58 | 59 | 60 |
| 61 | 62 | 63 | 64 | 65 | 66 | 67 | 68 | 69 | 70 |
| 71 | 72 | 73 | 74 | 75 | 76 | 77 | 78 | 79 | 80 |

| Playable Sets | |
|---|---|
| Set Configuration | Subset Size |
| 2X3 | 3 |
| 3X2 | 3 |

1002

FIG. 10A

| Playable Sets | |
|---|---|
| Set Configuration | Subset Size |
| 2X3 | 3 |
| 3X2 | 3 |

1002

| Playable Sets | |
|---|---|
| Set Configuration | Subset Size |
| 2X3 | 3 |
| 3X2 | 3 |

1002

OUTCOME VARIATION FOR GRID BASED NUMBER SELECTION GAMES

CROSS-REFERENCE TO RELATED APPLICATIONS

This application is a nonprovisional utility application of provisional patent application, Ser. No. 62/540,211 filed in the United States Patent Office on Aug. 2, 2017, claims priority therefrom, and is expressly incorporated herein by reference in its entirety.

TECHNICAL FIELD

The present disclosure relates generally to a method for providing outcome variations for grid based number selection games by introducing novel interactions with a set of randomly generated numbers referenced against a numerical grid. More particularly, the present disclosure relates to a method for playing games by which players place bets on predicted combinations of randomly determined numbers referenced against a numbered grid, which can be played as a novel standalone game or adapted to enable side bets for existing number based selection games such as Keno, Bingo, and lottery games.

BACKGROUND

The game of Keno is said to have originated as a government sponsored lottery in ancient China, but it remains popular as a wagering game which is not only accessible and easy to play but which still allows for potentially large payouts with a small wager. Keno can be played at most casinos, and is also widely available in lottery form.

The basic mechanics of Keno are simple. Keno is played on a grid which is ten squares wide and 8 squares tall, numbered from 1 to 80. Each round, twenty numbers are randomly drawn and then marked on the grid. To play Keno, each player makes a bet by selecting a group of up to ten numbers ranging from 1 to 80, with the goal of having those selected numbers match as many of the randomly drawn numbers as possible. Each bet is accompanied by a wager, which can generally be any amount between a set minimum and maximum. Once all participating players have submitted their bets, twenty numbers are drawn, and the results are made known to the players. Rewards are paid depending on how many matches occur out of the numbers selected by a player. Each Keno game has a predefined pay table listing which outcomes will result in a reward, along with the amount of the reward. A winning bet will receive a fixed amount for each dollar wagered, with the largest rewards being paid for outcomes with the lowest odds. Getting 10 matches out of 10 numbers picked is generally the best possible outcome resulting in a huge payout on even the smallest wager.

However, the longevity of Keno works against it, and many casinos have experienced a decline in Keno revenues as players begin to lose interest. The simplicity of Keno, long a part of its appeal, means that players can submit tickets for ten or more rounds at a time, leave the game, and come back at a later time to check their results. There is no real need for players to actually observe each round in progress, or actively strategize in between rounds. A string of unlucky games can leave a player with an impression of repetitive futility.

There are many variants of Keno, developed in the attempt to rejuvenate the game by introducing new betting methods, ways to win, or other means of making the game more interactive. Unfortunately, many variants fail to make meaningful changes, while others diverge so far from classic Keno that they prove to be distracting or wind up turning into a different game entirely. As a result, there remains a need for an improved version of Keno which increases player involvement and adds new layers of strategy without disturbing the fundamental rules of the game.

While these units may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a method for introducing outcome variations in a grid based number selection game, in which players place one or more bets, where each bet is a prediction of the quantity of sets with defined characteristics that will be formed by a random population of numbers referenced against a grid of squares. Each number within the random population corresponds to a numbered square on the grid, and whenever that number is drawn or generated during a game, the corresponding grid square becomes populated. Each set is a configuration of squares on a grid arranged in a particular pattern or shape. In order for a set to be formed on the grid, it must be placed on the grid in such a way as to contain within its shape or pattern, a certain quantity of populated squares. Prior to the start of each round in a game, one or more sets will be defined as playable sets. For a player to make a winning bet, the player must correctly predict the quantity of playable sets that will be formed by the random population of numbers drawn during each round of the game. Once all bets have been placed, the random population is generated and the corresponding grid squares become populated. Next, the total quantity of playable sets that can be placed on the grid using the populated squares are counted and compared against the bets placed by each player. Each player will then collect rewards for each winning bet, where the amount of the reward can be inversely proportional to the probability of the betted result occurring. In another embodiment, a game may feature a bonus round involving a bonus bet based on additional rule variations. By adjusting the configurations of the playable sets and the quantity of populated squares each playable set must cover, and introducing variant rules and bonus rounds, the house, which oversees the operation of the game and manages wagers and payouts, can introduce new strategic elements into the game between rounds to keep the game fresh and retain players who may otherwise lose interest in a more repetitive experience. Accordingly, the game can be implemented on a computerized platform, or can be played live such as in a traditional casino environment. The playing area can be represented using a physical apparatus, or depicted electronically via one or more of a computer display. The random population can be generated electronically using a random number generator, by randomized selection of numbered balls, or other means commonly employed in casinos and lotteries. Over the course of a game, the state of the grid, relevant game information, the positions of numbers, marks, and other interactions are regularly updated on the playing area. Player interactions, such as bets, player choices, and other player actions can be recorded electronically, or by marking paper tickets which are submitted to the house for processing.

According to an aspect of an embodiment of the present disclosure, the described elements can be used to play a novel grid based number selection game. The playing area can be made up of one or more shapes such as a square, quadrilateral, triangle, or other polygon, with each shape being divided into an ordered grid of numbered squares. The random population size can be set to equal any integer ranging from one to the total quantity of squares in the grid. The playable sets and their associated characteristics, along with payouts, variants, bonuses, and other rules can be adjusted by the house to account for different levels of play, difficulty, novelty, risk versus reward, and other factors related to the game experience.

It is yet a further aspect of an embodiment of the present disclosure to provide a method for enhancing an existing game such as Keno, Bingo, or a lottery game, by allowing side bets to be placed within the framework of that particular game. In a typical game of Keno, the player marks one or more of the grid squares on a ticket with the objective of matching the twenty random numbers of a draw. Each such match is referred to as a catch. Accordingly, in an exemplary embodiment implemented as an enhancement to a conventional game of Keno, the player would, in addition to the main Keno bet, place one or more side bets to predict how many playable sets can be placed on the grid over the twenty populated squares determined by the draw. The game may further employ a bonus round, based around how many playable sets can be placed over the grid which contain squares corresponding to catches, known as catch squares. The player may place one or more bonus bets to predict the quantity of playable sets which can be placed on the grid using only catch squares, known as catch sets.

Accordingly, by implementing various aspects of embodiments of the present disclosure, it is possible to introduce new strategic considerations and increase player involvement in an existing game, without disrupting the underlying nature of the original game.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

FIG. 3 is a diagram depicting a set with a 3×2 set configuration.

FIG. 5 is a diagram depicting a set in a 2×2 set configuration.

FIG. 6 is a diagram depicting a set in a 4×4 set configuration.

FIG. 7 is a diagram depicting a set in a 9×1 set configuration.

FIG. 8 is a diagram depicting a set in an "L" shape set configuration.

FIG. 10A is a diagram depicting a game of Keno implemented with a side bet, showing the grid squares selected by the player as circled squares, in accordance with an embodiment of the present disclosure.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
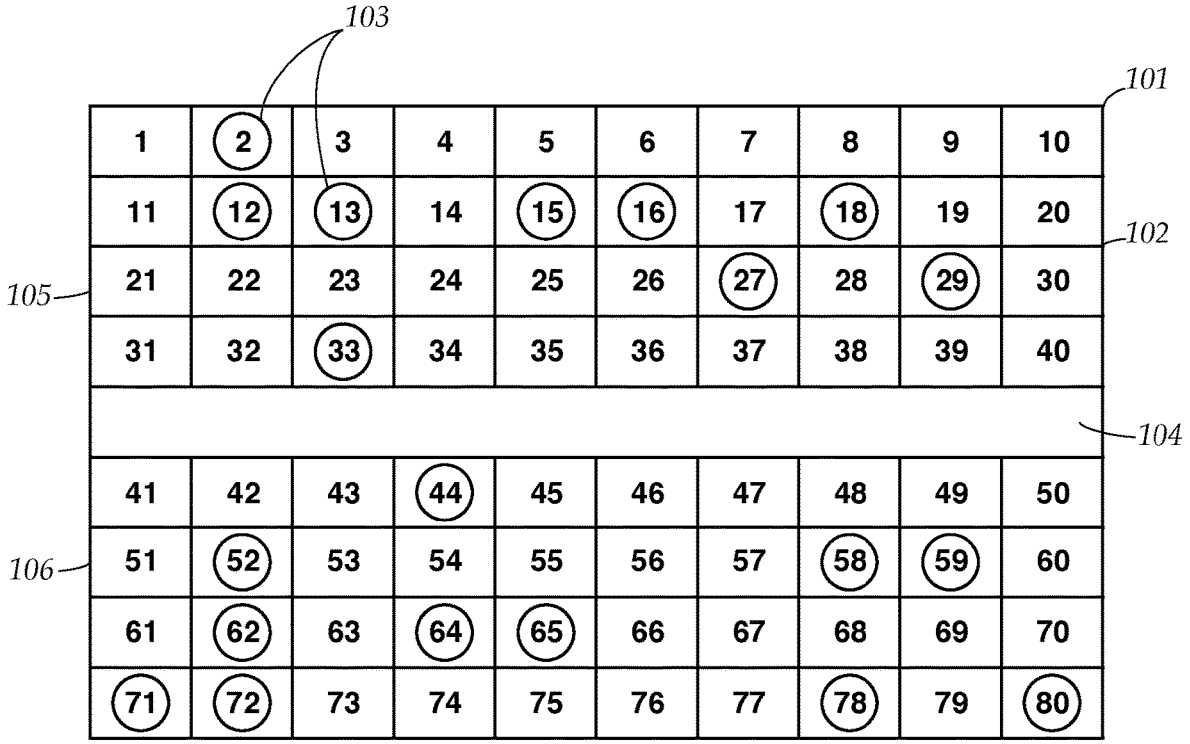
FIG. 1 is a diagram depicting a game with a playing area in the form of a grid similar to a typical Keno board, with twenty populated squares marked on the grid, in accordance with an embodiment of the present disclosure.

FIG. 1 illustrates an exemplary playing area 101 for a number selection game. The game is played over the course of one or more rounds, has a defined random population size, at least one or more of a set, with each set having a set configuration, and at least one or more of a set designated as a playable set for each round. The game must further have at least one player. The game can be implemented on a computerized game platform, or it can be played live such as in a traditional casino environment. The playing area 101 is comprised of a grid further comprised of an ordered arrangement of squares. Each square on the grid can contain a unique number, and the range of numbers appearing on the grid collectively comprise a superset. If a number drawn in the random population matches the number of a grid square, that square is marked and is referred to as a populated square. A set is a grouping of one or more squares arranged in a pattern or shape known as a set configuration. Each game has at least one defined set and set configuration. During each game round, at least one defined set, with its corresponding set configuration, is selected and designated as a playable set. A set designated as a playable set can be superimposed, formed, or placed on the grid over the grid squares. Each playable set has, in addition to a set configuration, a subset size. A playable set can be placed on the grid as long as its shape or pattern covers a quantity of populated squares equal to or greater than its subset size. During each round of the game, each player can place one or more bets each comprising a prediction count and a wager amount, where the goal is to make a winning bet where the prediction count matches the quantity of playable sets that will be placed on the grid for that round.

Figure 2:
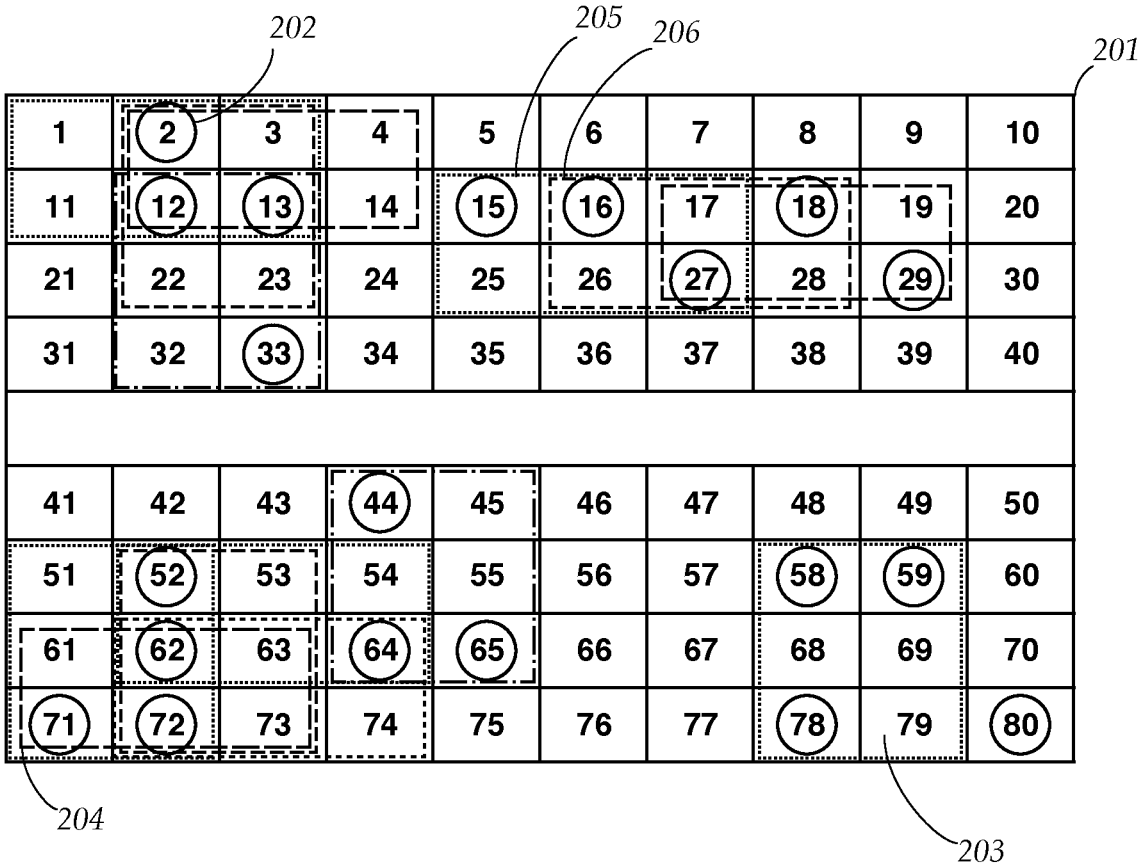
FIG. 2 is a diagram depicting the embodiment shown in FIG. 1, with a plurality of playable sets formed on the grid. Two sets with different set configurations are playable: 2×3 and 3×2.

The exemplary grid 102 shown in FIG. 1 has eighty squares arranged in eight rows and ten columns, but the game may be played using a grid of any size. The random population size is twenty, resulting in twenty numbers being drawn and marked on the grid 102 as a plurality of populated squares 103. The grid can further incorporate a border 104 dividing the grid into an upper zone 105 and a lower zone 106. In certain embodiments, the borders and zones can affect the placement of playable sets, or can simply be cosmetic with no effect on the game. FIG. 2 depicts the grid 201 with several playable sets placed on the grid over the populated squares 202. In the embodiment depicted, two playable sets have been defined for this round, with set configurations of 2×3 and 3×2 respectively and a subset size of three, which means each player must predict how many 2×3 and 3×2 playable sets, each covering at least three populated squares, will be formed based on the random population. The set configuration is characterized by the shape or pattern formed by the squares in the set. In order to distinguish each playable set on the grid, each playable set may be identified by a number pair referencing the numbers of the first and last grid squares covered by the pattern of each playable set, counting from left to right across rows, and from top to bottom. For example, the playable set 205 may be referred to as set (15, 27), and the grid squares of 15 and 27 also correspond to the upper left corner and lower right corner covered by the playable set. The first and second numbers of the number pair may also refer to the first and last grid squares covered by the set, counting across the rows from left to right. For example, playable set (58, 79) 203 has a set configuration of 2×3 and comprises six squares in a pattern that is two squares wide and three squares tall. Playable set (61, 73) 204 has a set configuration of 3×2 and comprises six squares in a pattern that is three squares wide and two squares tall. The subset size is three, therefore each playable set placed on the grid must cover at least three populated squares within its shape or pattern. For example, playable set (61, 73) 204 covers the populated squares 62, 71, and 72. In the embodiment depicted here in FIG. 2, there are fourteen playable sets placed on the grid, and any bet with a prediction count of fourteen would therefore be a winning bet. In certain embodiments, the playable sets may be required to be placed such that each playable set covers a quantity of populated squares exactly equal to the subset size of the playable set, making it more difficult to place playable sets on the grid. Alternative prediction counts are also contemplated in the present disclosure. Each player may be required to predict the quantity of populated squares which is covered by each playable set. For example, if a set having a 3×2 set configuration and a subset size of 3 is defined as the playable set for the current round, the player may be required to predict the quantity of 3×2 playable sets placed on the grid which also cover a quantity of populated squares matching the player's prediction count. The player may, for example, make a prediction count predicting that three 3×2 playable sets, each covering four populated squares, will be placed on the grid.

Figure 4:
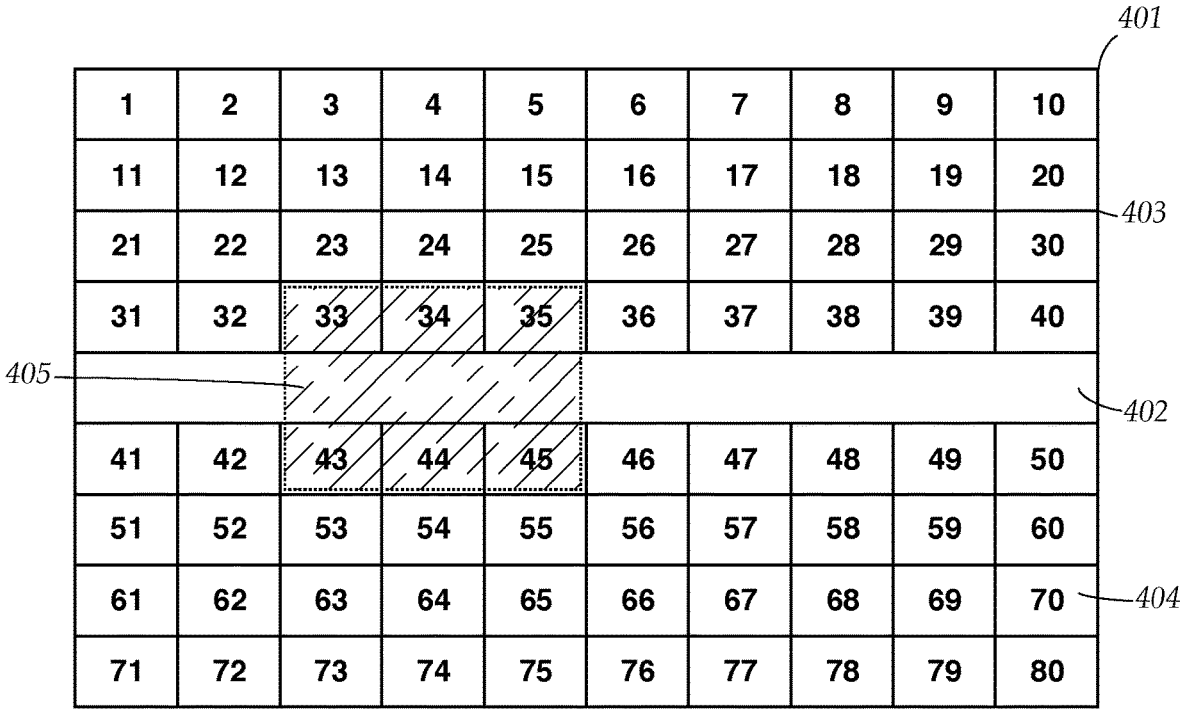
FIG. 4 is a diagram depicting a set in a 3×2 set configuration placed on a grid, straddling the border between the upper and lower zones of the grid.

Further set configurations are possible, with FIGS. 3-8 depicting set configurations arranged in various patterns. FIGS. 3 and 4 show set (12, 24) 302 and set (33, 45) 405 which both have a 3×2 set configuration. FIG. 5 shows set (13, 24) 501 which has a set configuration of 2×2. FIG. 6 shows set (44, 77) 601 which has a set configuration of 4×4. FIG. 7 shows set (22, 30), which has a 1×9 set configuration. FIG. 8 depicts set (54, 66) 801 with an "L" set configuration comprising 4 squares arranged in an "L" shape. The quantity of squares in a set can range from one square, to a total equal to the highest number in the subset. For example, if the highest number in a subset is eighty, the greatest quantity of squares that a set can contain is eighty squares.

Turning back to FIG. 2, playable sets can overlap other playable sets when placed on the grid, and each populated square may be covered by two or more playable sets, but two playable sets of the same set configuration cannot occupy the exact same grid squares. For example, the 3×2 playable set (15, 27) 205 occupies the populated squares 15, 16, and 27, and overlaps with the 3×2 playable set (16, 28) 206 which occupies the populated squares 16, 18, and 27. However, no other playable set having the 3×2 set configuration may be placed over the same grid squares occupied by either set (15, 27) 205 or set (16, 28) 206. When the playing area has eighty squares arranged in a grid of ten columns of eight squares, there are fifty-four possible locations which playable sets of a 2×3 set configuration can occupy, and fifty-six possible locations for playable sets of a 3×2 set configuration.

Figure 9A:
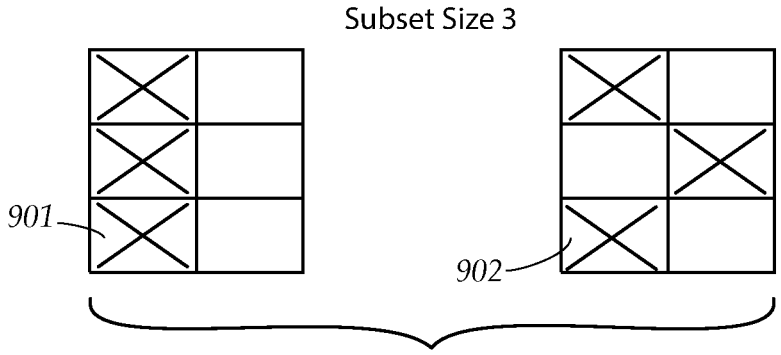
FIG. 9A is a diagram depicting sets with a subset size of 3.
Figure 9B:
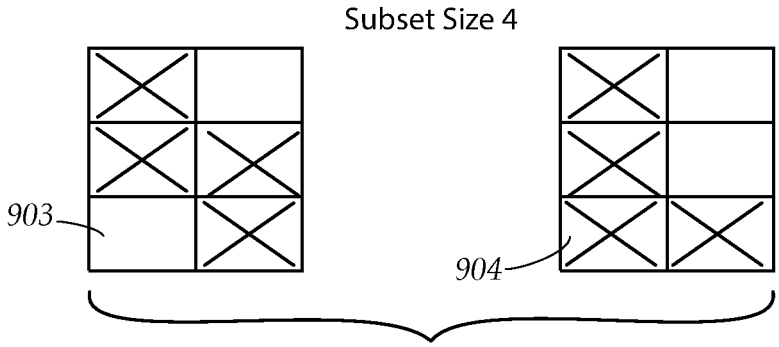
FIG. 9B is a diagram depicting sets with a subset size of 4.
Figure 9C:
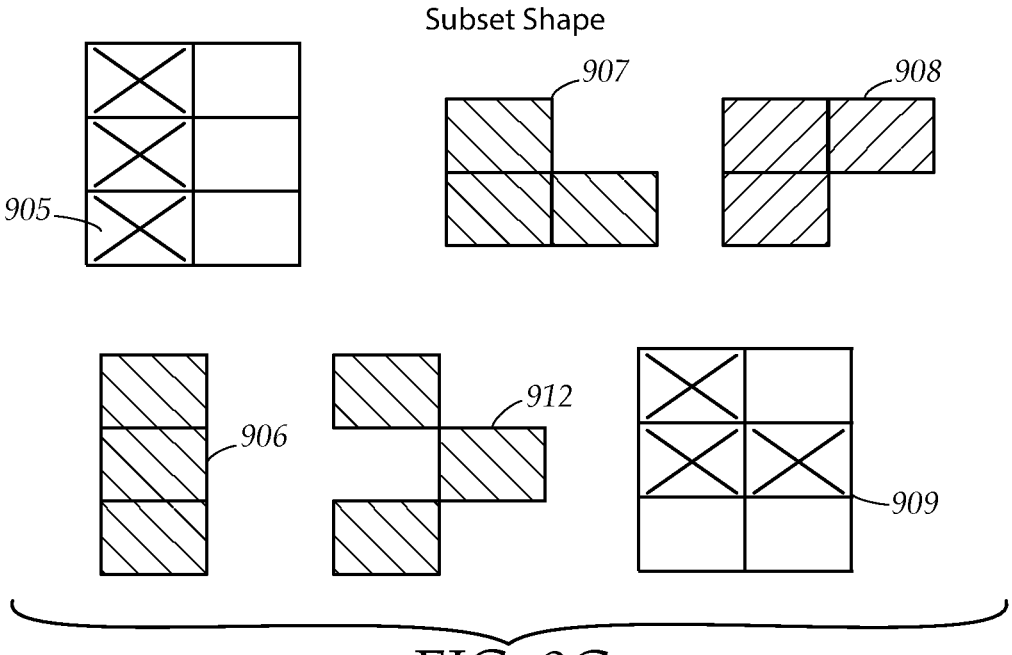
FIG. 9C is a diagram depicting various subset shapes.

Various combinations of set configuration and subset size are contemplated within the present disclosure. FIG. 9A depicts two example 2×3 sets 901, 902 each with a subset size of 3. 9B depicts two example 2×3 sets 903, 904, each with a subset size of 4. Increasing the subset size may make it more difficult to successfully place a set on the grid. Similarly, increasing the random population size makes it easier to place more sets, as there will be a greater density of populated squares on the grid, while reducing the random population size has the opposite effect. With a 2×3 playable set, depending on the subset size and the random population size, it may be possible for no sets to be placed on the grid at all, while it may also be possible for all fifty-six potential sets to be placed as long as there are a sufficient quantity of populated squares in play. A playable set may have a set configuration that further comprises a subset shape having one or more populated squares arranged in a defined shape or pattern. For a playable set with a defined subset shape to be placed on the grid, the playable set must cover with its shape or pattern a grouping of populated squares matching the defined subset shape. FIG. 9C depicts a 2×3 set 905 with a subset shape 906 of three vertically arranged populated squares. A 2×3 set 909 is also shown, with a subset shape 907 of three populated squares arranged in a bent shape. Referring back to FIG. 9A while continuing to refer to FIG. 9C, the 2×3 set 902 shown in FIG. 9A contains a subset 912 as shown in FIG. 9C which shows one populated square arranged diagonally with two other populated squares. In certain embodiments, the subset shapes can be rotated or mirrored about an axis, as shown in the relationship between subset shape 907 and its mirrored variant 908.

When at least one playable set and its associated subset size and payout table are defined, each player may place one or more of a bet comprising a prediction count and a wager. Each playable set has an associated payout table, comprising a list of potential outcomes such as the predicted quantity of playable sets that will be placed on the grid for the round, and the reward to be paid to each player who makes a winning bet with a prediction count matching that potential outcome. The amount rewarded for a bet can be calculated according to the odds that the potential outcome will occur, with longer odds offering more lucrative rewards. Players can be given the opportunity to increase the wager amount, increasing exposure to greater losses but also increasing potential payouts. The game can allow the player to increase the amount wagered on a potential outcome by allowing multiple bets per outcome where each bet is associated with a fixed wager amount, or specify the amount wagered for each specific outcome for which the player is betting.

Figure 10B:
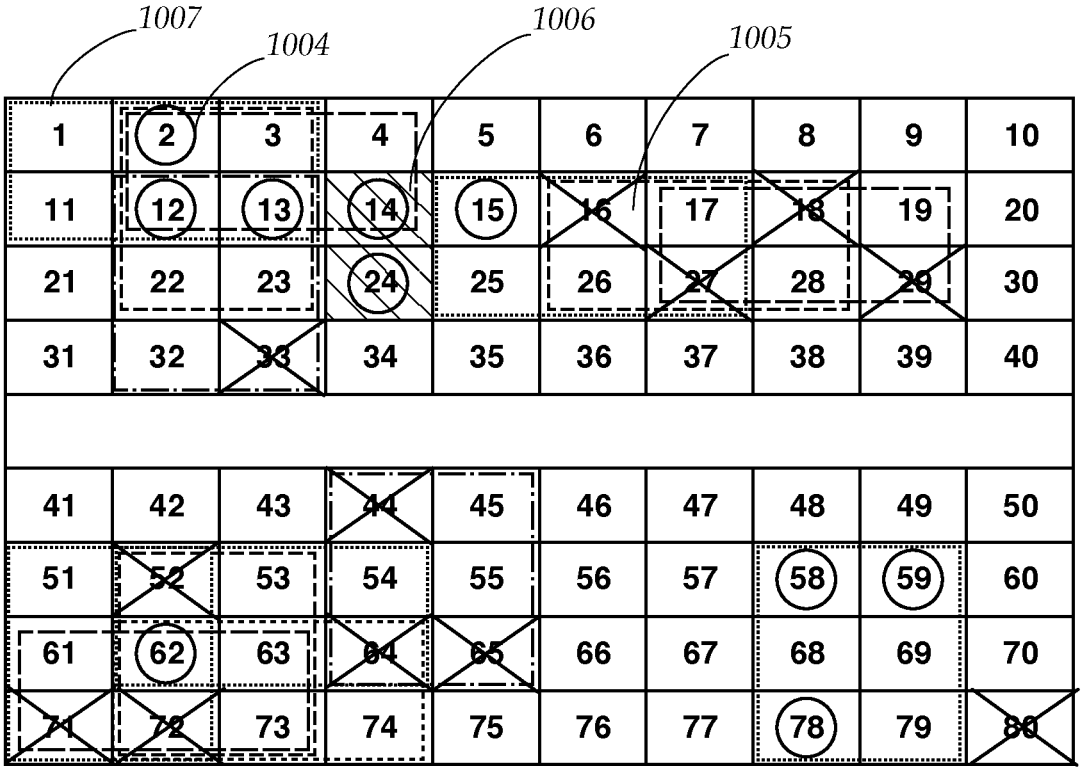
FIG. 10B is a diagram depicting the Keno game, with the random population marked on the grid with catch squares shown as circled grid squares, in accordance with an embodiment of the present disclosure.

In certain embodiments, the game can be implemented as an enhancement to a conventional Keno game or other main number selection game, by allowing players to place side bets without adversely altering the main game. A game can be implemented using a computerized interface, or it can be played live such as in a casino environment. Turning to FIG. 10A, a playing area comprising a grid 1001 of eighty squares arranged in ten columns of eight squares is used to play an enhanced Keno game. The random population size may be 20 numbers, which is the size of a typical Keno draw. Two playable sets 1002 are defined, with 2×3 and 3×2 set configurations, and a subset size of 3. A player places a main bet by marking a series of numbers using a ticket or a computer interface, where the goal is to predict which numbers will be drawn in the random population. In the present example, the player has marked ten player selected numbers depicted as circled numbers 1003. Next, the player may place one or more side bets comprising a prediction count and a wager amount, where the prediction count is a prediction of how many playable sets will be formed after the random population is drawn and marked on the grid. Once all main bets and side bets have been placed, the twenty numbers in the random population are drawn and marked on the grid. FIG. 10B shows the positions of the numbers comprising the random population, along with the positions of the player selected numbers. In this example, the random population includes the same numbers shown in FIGS. 1 and 2. Where a player selected number matches a number in the random population, the corresponding square is referred to as a catch square 1004, which remains circled for illustrative purposes only. Player selected numbers which do not match the random population are depicted as darkened squares 1006 purely for purposes of illustration. Similarly, each square corresponding to a number in the random population but which is not a player selected number is a populated square marked with an X symbol 1005 for purposes of illustration. As contemplated in the present disclosure, other symbols, colors, marks, or other characteristics can be used to visually distinguish squares and numbers of different types on a playing area, and the depictions here are illustrative only. After the random population is drawn and marked on the playing area, the results of the main bet are calculated by counting how many of each player's player selected numbers correspond to the numbers in the random population. Next, the side bets are resolved by calculating how many playable sets of the defined set configuration and set size can be formed over the populated squares 1005, including catch squares 1004. In the example depicted in FIG. 10B, the resulting playable sets are the same as those shown in FIG. 2, and six 2×3 playable sets and eight 3×2 playable sets are formed, for a total of fourteen. Once the results of the main bets and side bets have been determined, rewards are paid out to each player for each winning bet. The rewards for the main bet can be determined using a standard Keno payout table. The rewards for the side bets can be determined using probability factors (such as the odds of thirteen playable sets being formed, based on the defined variables of the game) and be paid to each player. Other reward configurations are contemplated in the present disclosure, such as a side bet reward in the form of a multiplier which increases the payout for a winning main bet.

Embodiments of the present disclosure can be adapted to implement side bets in other grid based number selection games such as lottery games. It would be apparent to one of ordinary skill in the art in the field of the invention to appropriately modify the elements described in the present disclosure to implement side bets for predicting combinations of numbers on a grid with a small random population, such as the six numbers drawn in a "pick 6" lottery game.

Figure 10C:
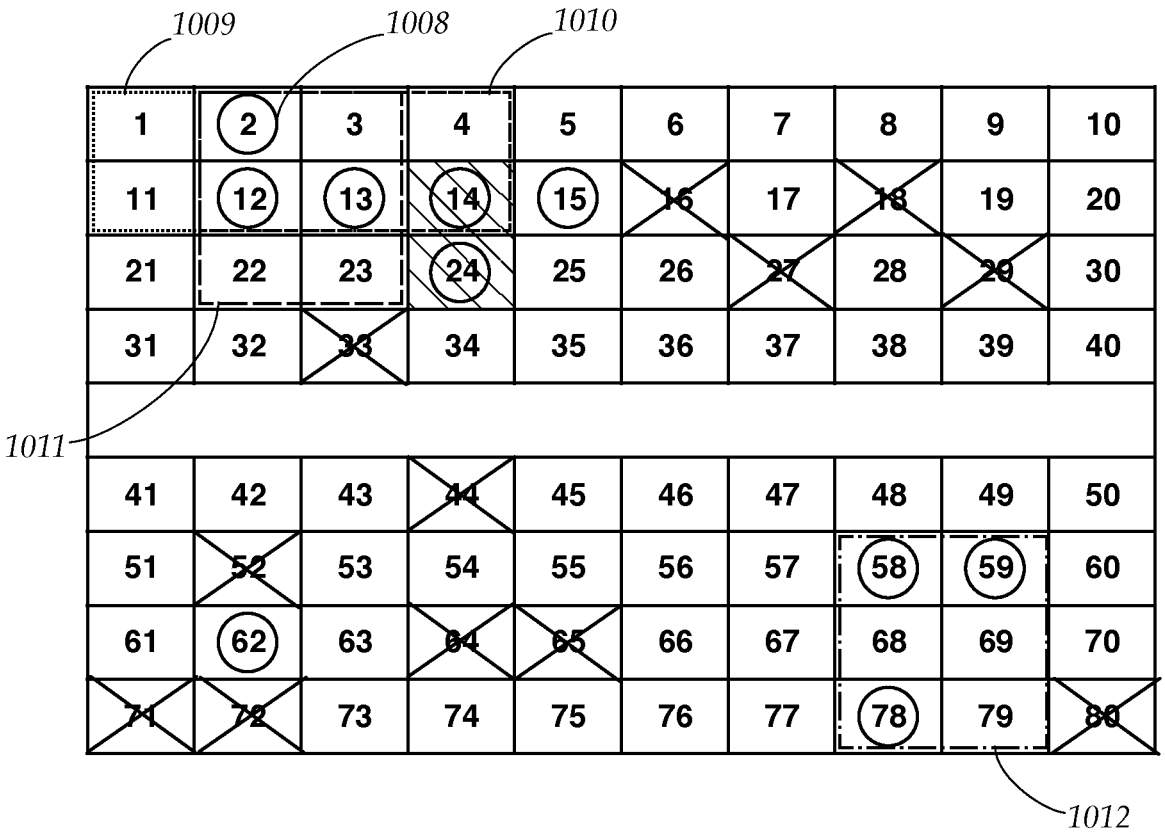
FIG. 10C is a diagram depicting the Keno game with catch sets placed on the grid over the catch squares, in accordance with an embodiment of the present disclosure.

In certain embodiments, the game may be used to enhance an existing number selection game by further introducing a bonus round in addition to or in place of the side bet. The example game as depicted in FIGS. 10A-B can further incorporate a bonus round, which can be a variant of the side bet. In the embodiment depicted in FIG. 10C, each player may place one or more bonus bets comprising a prediction count and a wager amount, the object of which is to predict a potential outcome of how many playable sets will be formed using only the catch squares, illustrated as circled squares 1008, with such sets referred to as catch sets. Two 2×3 sets (2, 23) 1011, (58, 79) 1012 are formed over the catch squares, along with two 3×2 sets (1, 13) 1009, (2, 14) 1010 for a total of four playable sets. Note that the bonus round may utilize any of the variations detailed herein regarding the set configuration, the subset size, and the subset shape of the sets defined for the bonus round, as well as conditions which control the placement of the playable sets on the grid. The implementation of the bonus round introduces new strategic options for the player, as the player can decide to alter the main bet by placing the player selected numbers in certain grid positions in order to increase the chances for a winning bonus bet, but at the risk of altering their chances of placing a winning main bet. Bonus bets are placed at the same time as main bets and side bets, and are resolved after the results of side bets are calculated. Bonus rewards can be paid out independently to each player, or can be used to increase the rewards for main bets or side bets.

Figure 11:
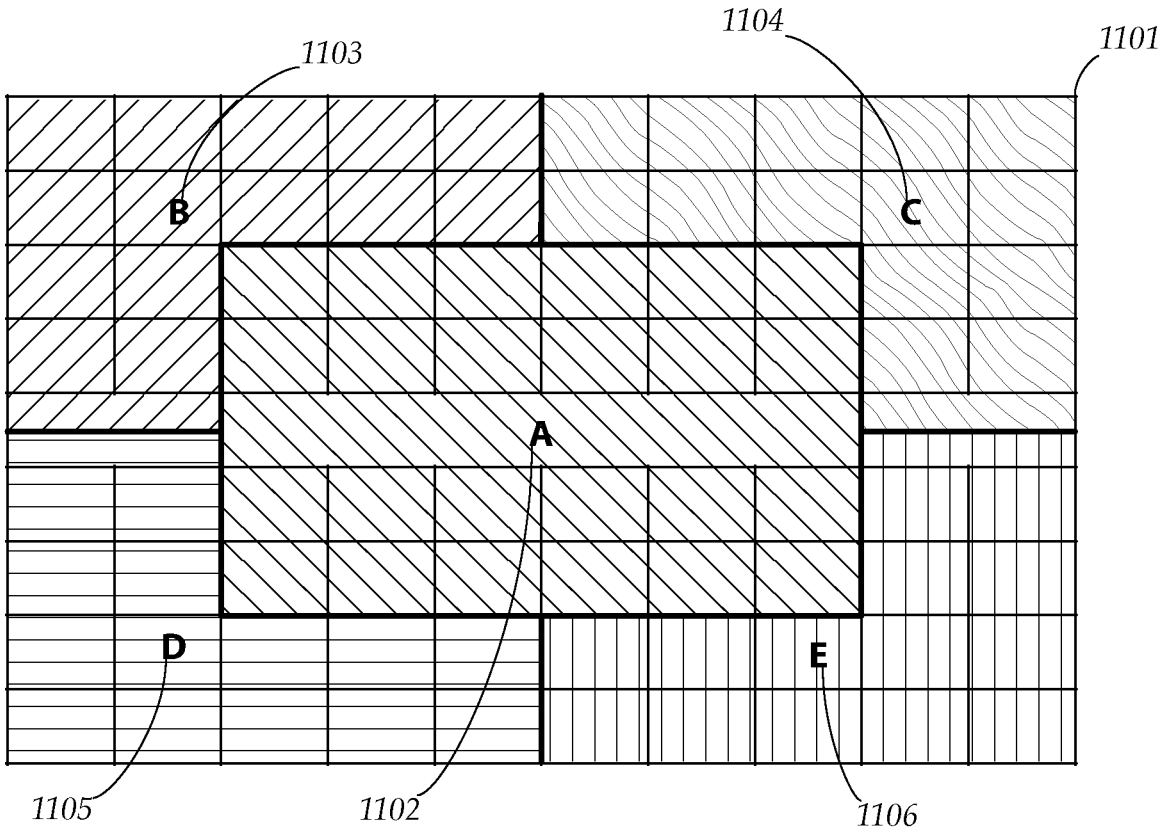
FIG. 11 is a diagram depicting a grid further divided into zones, in accordance with an embodiment of the present disclosure.

It is yet a further aspect of an embodiment of the present disclosure to provide additional outcome variations for a grid based number selection game by implementing grid variables. A grid variable controls game interactions relating to a grid by defining one or more grid zones on a grid which can affect the placement of playable sets. Turning back to FIG. 1, the border 104 divides the grid 101 into an upper zone 105 and a lower zone 106. In an embodiment where grid zones are in play, a playable set may not be placed on the grid if the shape of the set would cover squares within more than one grid zone. Turning to FIG. 4, a 3×2 playable set 405 is placed on the grid 401 over squares from both the upper zone 403 and lower zone 404. If grid zone restrictions are in play, this would be an impermissible placement. Other grid variables are contemplated in embodiments of the present disclosure. Turning to FIG. 11, a grid 1101 is shown, comprised of five grid zones 1102-1106. A grid variable can be defined for a game round specifying that playable sets may only be formed within one or more designated grid zones.

Figure 12A:
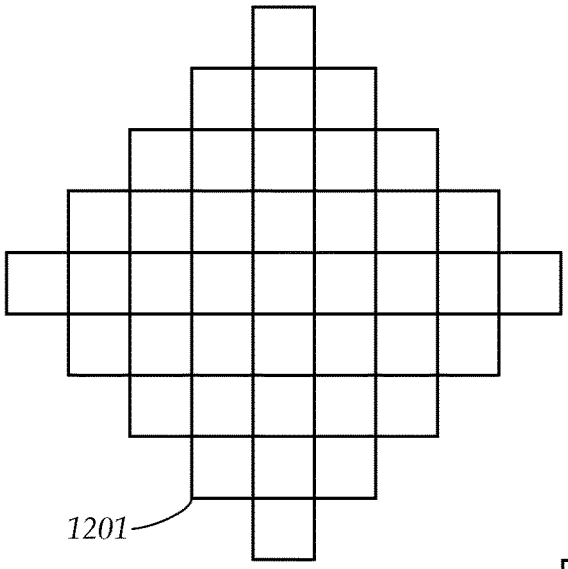
FIG. 12A depicts an alternatively shaped grid shaped having a diamond shape, in accordance with embodiments of the present disclosure.
Figure 12B:
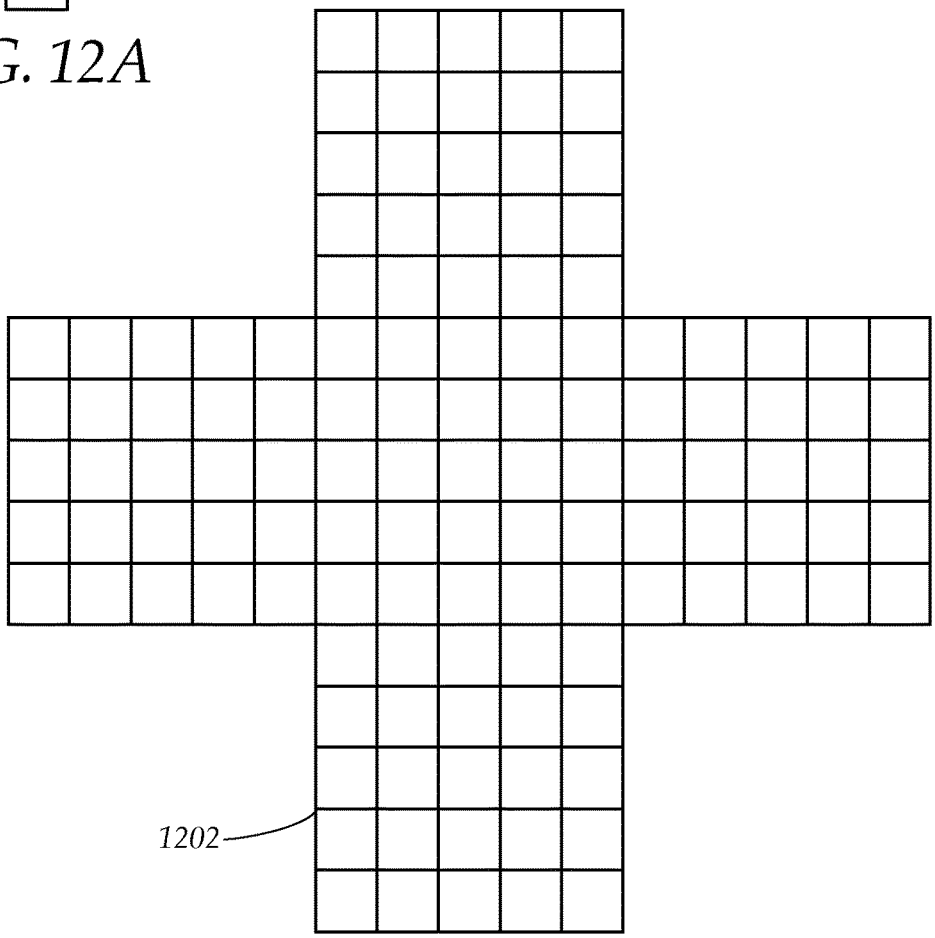
FIG. 12B depicts an alternatively shaped grid having a cross shape, in accordance with an embodiment of the present disclosure.

According to an aspect of an embodiment of the present disclosure, a playing area can be formed in a shape other than a rectangle, when an embodiment is implemented as a standalone game. FIGS. 12A and 12B depict grids arranged in a rhombus pattern 1201 and a cross pattern 1202.

Other types of game conditions, side bets, and bonus bets incorporating different set and grid variables are contemplated in the present disclosure and it would be apparent to one of ordinary skill in the art in the field of the invention to combine the variations described to provide further outcome variations for a grid based number selection game.

Figure 13:
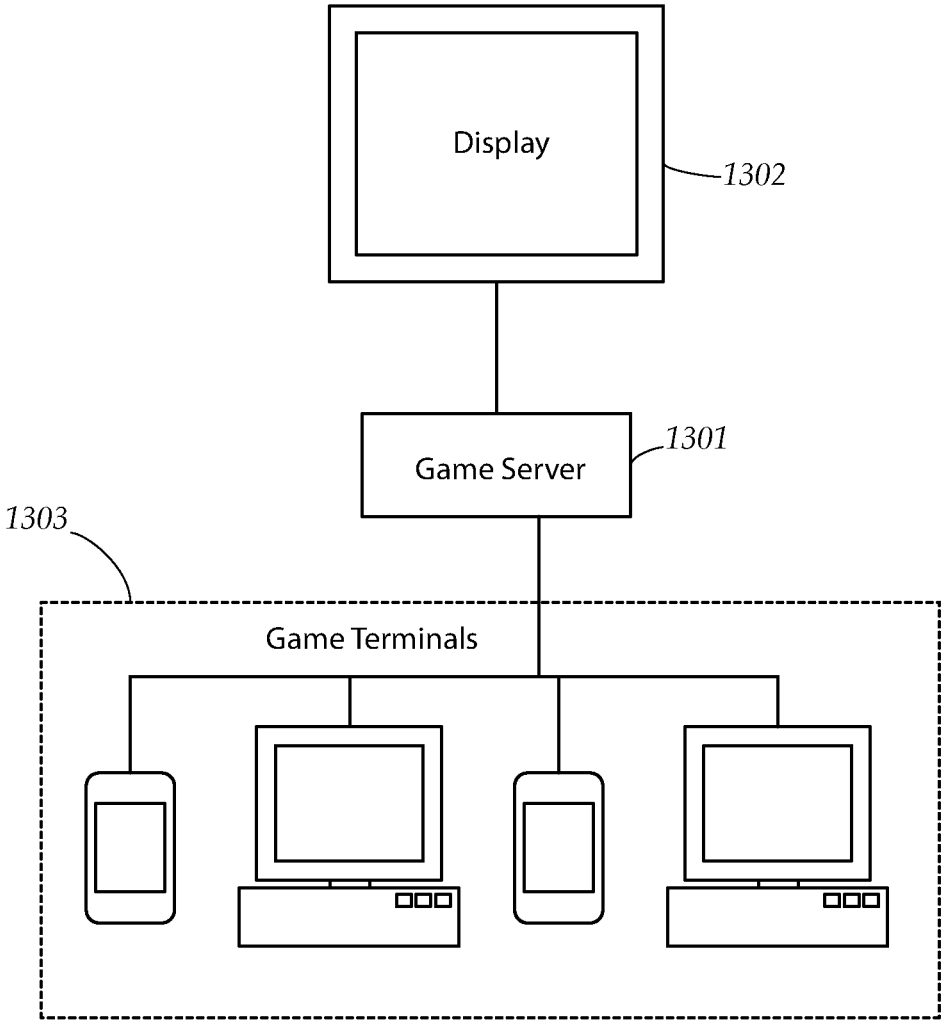
FIG. 13 is a diagram depicting a computerized system for playing a grid based number selection game.

Turning to FIG. 13, an example system is shown, on which an aspect of an embodiment of the present disclosure can be implemented. A system can be comprised of at least one game server 1301 having a processor and memory, one or more displays 1302 for presenting a graphical representation of the game, and one or more game terminals 1303 connected to one or more game servers having an input device and a display device. The game terminals and the game server can be connected via a local area network, such as when the system is implemented as an electronic game played within a casino. The system can also be implemented to be played over the Internet, where players use game terminals in the form of personal computers and mobile devices to connect to a game server hosting a game.

As will be appreciated by one skilled in the art, aspects of the present disclosure may be embodied as a system, method or computer program product. Accordingly, aspects of the present disclosure may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present disclosure may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium (including, but not limited to, non-transitory computer readable storage media). A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate or transport a program for use by or in connection with an instruction execution system, apparatus or device.

Program code embodied on a computer readable medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages, including an object oriented programming language such as Java, Smalltalk, C++ or the like and conventional procedural programming languages, such as the "C" programming language or similar programming languages. Other types of languages include XML, XBRL and HTML5. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present disclosure are described below with reference to flowchart illustrations and/or block diagrams of methods, apparatus (systems) and computer program products according to embodiments of the disclosure. Each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the Figures illustrate the architecture, functionality and operation of possible implementations of systems, methods and computer program products according to various embodiments of the present disclosure. In this regard, each block in the flowchart or block diagrams may represent a module, segment or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. Each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

The flow diagrams depicted herein are just one example. There may be many variations to this diagram or the steps (or operations) described therein without departing from the spirit of the disclosure. For instance, the steps may be performed in a differing order and/or steps may be added, deleted and/or modified. All of these variations are considered a part of the claimed disclosure.

In conclusion, herein is presented a method for providing outcome variation for grid based number selection games. The disclosure is illustrated by example in the drawing figures, and throughout the written description. It should be understood that numerous variations are possible, while adhering to the inventive concept. Such variations are contemplated as being a part of the present disclosure.

What is claimed is:

1. A method of playing a number selection game, the method being performed by a computer system that comprises at least one processor, an input, a random number generator, a display for displaying graphical representations of the number selection game, a memory operatively coupled to the at least one processor, and a computer-readable storage medium encoded with instructions executable by at least one of the processors and operatively coupled to the at least one processor, the method comprising the steps of:

providing, via the display, a grid comprising a plurality of grid squares organized as a plurality of rows and a plurality of columns, each grid square containing a unique number;

defining one or more sets by the processor along with a set configuration and a subset size for each set, the set configuration is a pattern formed from a defined quantity of the grid squares, each grid square within the pattern is adjacent to at least one of the other grids squares within the pattern, the subset size is a defined numerical value;

designating, by the processor, one or more of the sets as a playable set eligible to be placed onto the grid;

displaying, on the display device, a graphical representation of the grid;

accepting, via the input, a bet by the player, wherein the processor is configured to allow the player to input a prediction count predicting the quantity of playable sets placed on the grid;

generating, by the processor, a random population using the random number generator, the random population comprising a plurality of unique numbers drawn from the numbers represented on the grid;

populating, by the processor, each grid square which matches one of the numbers of the random population to create a populated square;

displaying, on the display device, graphical representations of the playable sets defined by the processor on the graphical representation of the grid by superimposing a graphical representation of the squares of the pattern of each playable set over the display of the graphical representation of the grid squares so that the quantity of populated squares covered by said pattern is equal to the subset size of the playable set, whereby each playable set cannot occupy all the grid squares covered by another playable set having the same set configuration;

repeating, by the processor, the step of displaying the graphical representations of the playable sets on the grid until no further playable sets can be placed;

counting, by the processor, the total quantity of playable sets placed on the grid; and determining, by the processor, winning bets, designating each bet as a winning bet if the prediction count of the bet is equal to the quantity of playable sets placed on the grid.

2. The method as described in claim 1, wherein:

t67t6 the step of placing a bet by the player further comprises the step of the player making a wager; and the step of determining winning bets is followed by the step of paying a reward to the player for each of the winning bets.

3. The method as described in claim 2, wherein the graphical representation of the grid squares are arranged into one or more zones, each zone surrounded by a graphical representation of a boundary; and the step of displaying the graphical representations of the playable sets on the graphical representation of the grid further comprises superimposing the graphical representation of the squares of the pattern of each playable set over the graphical representation of the grid squares so that said pattern is entirely within the graphical representation of boundary of one of the zones.

4. The method as described in claim 3, wherein the grid comprises at least two zones.

5. The method as described in claim 2, wherein:

the step of defining one or more sets further comprises the step of defining a subset shape comprising a quantity of squares equal to the subset size arranged in a shape whereby each square within the shape is adjacent to at least one of the other squares within the shape; and the step of displaying, on the display device, the graphical representations of the playable sets on the grid comprises superimposing the graphical representation the squares of the pattern over the graphical representation of the grid squares so that the quantity of populated squares covered by the pattern of the set configuration is equal to the subset size of the playable set and only when said populated squares form a graphical representation of a shape which matches the subset shape, whereby each playable set cannot occupy all the grid squares covered by another playable set having the same set configuration.

6. The method as described in claim 2, wherein:

the step of placing a bet by the player further comprises the step of the player making a prediction count predicting the quantity of playable sets placed on the grid and the quantity of the populated squares covered by the pattern of each playable set;

the step of displaying, on the display device, graphical representations of the playable sets on the grid further comprises superimposing the graphical representation of the squares of the pattern of each playable set over the display of the graphical representation of the grid squares so that the quantity of the populated squares covered by said pattern is equal to or greater than the subset size of the playable set, whereby each playable set cannot occupy all the grid squares covered by another playable set having the same set configuration;

the step of counting the total quantity of playable sets placed on the grid further comprises counting the total quantity of playable sets placed on the grid and the total quantity of the populated squares covered by each playable set; and the step of determining winning bets, designating each bet as a winning bet if the prediction count of the bet matches the quantity of playable sets placed on the grid and the quantity of populated squares covered by said playable sets.

7. A method for increasing outcome variations for a main game, the main game being a grid based number selection game managed by a house, the main game having a player who places a main bet, the main game further having a random population of unique numbers, and a main winning condition determined by the random population, the method being performed by a computer system that comprises at least one processor, an input, a random number generator, a display for displaying graphical representations of the number selection game, a memory operatively coupled to at least one of the processors, and a computer-readable storage medium encoded with instructions executable by the at least one processor and operatively coupled to the at least one processor, the method comprising the steps of:

providing, by the processor, a grid comprising a plurality of grid squares, each grid square containing a unique number;

displaying, on the display device, a graphical representation of the grid;

defining, by the processor, one or more sets by the house along with a set configuration and a subset size for each set, the set configuration is a defined quantity of squares arranged in a pattern, each square within the pattern is adjacent to at least one of the other squares within the pattern, the subset size is a defined numerical value;

designating, by the processor, one or more of the sets as a playable set eligible to be placed on the grid;

accepting, via the input, a side bet by the player, the player making a prediction count predicting the quantity of playable sets placed on the grid;

playing the main game by the processor executing instruction for generating the random population using the random number generator, creating a populated square by populating each grid square which matches one of the numbers of the random population, and determining a winning main bet by designating each main bet that matches the main winning condition as a winning main bet;

displaying, on the display device, graphical representations of the playable sets on the graphical representation of the grid by superimposing a graphical representation of the squares of the pattern of each playable set over the display of the graphical representation of the grid squares so that the quantity of populated squares covered by said pattern is equal to or greater than the subset size of the playable set, whereby each playable set cannot occupy all the grid squares covered by another playable set having the same set configuration;

repeating, by the processor the step of displaying the playable sets on the grid until no further playable sets can be placed;

counting the total quantity of playable sets placed on the grid; and determining winning side bets, designating each side bet as a winning side bet if the prediction count of the side bet is equal to the quantity of playable sets placed on the grid.

8. The method as described in claim 7, wherein:

the step of placing a bet by the player further comprises the step of the player making a wager; and the step of determining winning side bets is followed by the step of paying a reward to the player for each of the winning side bets.

9. The method as described in claim 7, wherein:

the step of playing the main game further comprises placing a main game wager, generating the random population, creating a populated square by populating each grid square which matches one of the numbers of the random population, determining a winning main bet by designating each main bet that matches the main winning condition as a winning main bet, and paying a main game reward to the player for each winning main bet; and the step of determining winning side bets is followed by the step of increasing the main game reward for each winning side bet.

10. The method as described in claim 8, wherein:

the graphical representation of the grid squares are arranged into one or more zones, each zone surrounded by a graphical representation of a boundary; and the step of displaying the graphical representations of the graphical representation of the playable sets on the grid further comprises superimposing the graphical representation of the squares of the pattern of each playable set over the graphical representation of the grid squares so that said pattern is entirely within the graphical representation of the boundary of one of the zones.

11. The method as described in claim 10, wherein the grid comprises at least two zones.

12. The method as described in claim 10, wherein:

the step of defining one or more sets further comprises the step of defining a subset shape comprising a quantity of squares equal to the subset size arranged in a shape whereby each square within the shape is adjacent to at least one of the other squares within the shape; and the step of displaying the graphical representations of the playable sets on the grid comprises superimposing the graphical representation of the squares of the pattern of each playable set over the graphical representation of the grid squares so that the quantity of the populated squares covered by said pattern is equal to the subset size of the playable set and only when said populated squares form a graphical representation of a shape which matches the subset shape, whereby each playable set cannot occupy all the grid squares covered by another playable set having the same set configuration.

13. The method as described in claim 10, wherein:

the step of placing a bet by the player further comprises the step of the player making a prediction count predicting the quantity of playable sets placed on the grid and the quantity of the populated squares covered by the pattern of each playable set;

the step of displaying, on the display device, graphical representations of the playable sets on the grid further comprises superimposing the graphical representation of the squares of the pattern of each playable set over the display of the graphical representation of the grid squares so that the quantity of the populated squares covered by said pattern is equal to or greater than the subset size of the playable set, whereby each playable set cannot occupy all the grid squares covered by another playable set having the same set configuration;

the step of counting the total quantity of playable sets placed on the grid further comprises counting the total quantity of playable sets placed on the grid and the total quantity of the populated squares covered by each playable set; and the step of determining winning side bets, further comprises designating each bet as a winning side bet if the prediction count of the side bet matches the quantity of playable sets placed on the grid and the quantity of the populated squares covered by said playable sets.

14. A method for increasing outcome variations for a main game, the main game being a grid based number selection game managed by a house, the main game having a player who places a main bet, the main game further having a random population of unique numbers, and a main winning condition determined by the random population, the method being performed by a computer system that comprises at least one processor, an input, a random number generator, a display for displaying graphical representations of the number selection game, a memory operatively coupled to the at least one processor, and a computer-readable storage medium encoded with instructions excitable by the at least one processor and operatively coupled to the at least one processor, the method comprising the steps of:

providing a grid comprising a plurality of grid squares, each grid square containing a unique number;

displaying, on the display device, a graphical representation of the grid;

defining one or more sets by the house, along with a set configuration and a subset size for each set, the set configuration is a defined quantity of squares arranged in a pattern, each square within the pattern is adjacent to at least one of the other squares within the pattern, the subset size is a defined numerical value;

designating one or more of the sets as a playable set eligible to be placed on the grid;

placing, via the input, a side bet by the player, the player making a prediction count predicting the quantity of playable sets placed on the grid;

playing the main game, the player selecting one or more of the grid squares, generating the random population using the random number generator, creating a catch square by populating each grid square selected by the player which also matches one of the numbers of the random population, determining a winning main bet by designating each main bet that matches the main winning condition as a winning main bet;

displaying, on the display device, graphical representations of the playable sets on the graphical representation of the grid by superimposing a graphical representation of the squares of the pattern of each playable set over the display of the graphical representation of the grid squares so that the quantity of catch squares covered by said pattern is equal to or greater than the subset size of the playable set, whereby each playable set cannot occupy all the grid squares covered by another playable set having the same set configuration;

repeating the step of placing the playable sets on the grid until no further playable sets can be placed;

counting the total quantity of playable sets placed on the grid; and determining winning side bets, designating each side bet as a winning side bet if the prediction count of the side bet is equal to the quantity of playable sets placed on the grid.

15. The method as described in claim 14, wherein:

the step of placing a bet by the player further comprises the step of the player making a wager; and the step of determining winning side bets is followed by the step of paying a reward to the player for each of the winning side bets.

16. The method as described in claim 14, wherein:

the step of playing the main game further comprises the player placing a main game wager, the player selecting one or more of the grid squares, generating the random population, creating a catch square by populating each grid square selected by the player which also matches one of the numbers of the random population, determining a winning main bet by designating each main bet that matches the main winning condition as a winning main bet, and paying a main game reward to the player for each winning main bet; and the step of determining winning side bets is followed by the step of increasing the main game reward for each winning side bet.

17. The method as described in claim 15, wherein:

the graphical representation of the grid squares are arranged into one or more zones, each zone surrounded by a graphical representation of a boundary; and the step of displaying the graphical representations of the playable sets on the grid further comprises superimposing the graphical representation of the squares of the pattern of each playable set over the graphical representation of the grid squares so that said pattern is entirely within the graphical representation of the boundary of one of the zones.

18. The method as described in claim 17, wherein the grid comprises at least two zones.

19. The method as described in claim 17, wherein:

the step of defining one or more sets further comprises the step of defining a subset shape comprising a quantity of squares equal to the subset size arranged in a shape whereby each square within the shape is adjacent to at least one of the other squares within the shape; and the step of displaying the graphical representations of the playable sets on the grid comprises superimposing the graphical representation of the squares of the pattern of each playable set over the graphical representation of the grid squares so that the quantity of the catch squares covered by said pattern is equal to the subset size of the playable set and said catch squares form a graphical representation of a shape which matches the subset shape, whereby each playable set cannot occupy all the grid squares covered by another playable set having the same set configuration.

20. The method as described in claim 17, wherein:

the step of placing a bet by the player further comprises the step of the player making a prediction count predicting the quantity of playable sets placed on the grid and the quantity of the catch squares covered by the pattern of each playable set;

the step of displaying, on the display device, graphical representations of the playable sets on the grid further comprises superimposing the graphical representation of the squares of the pattern of each playable set over display of the graphical representation of the grid squares so that the quantity of catch squares covered by said pattern is equal to or greater than the subset size of the playable set, whereby each playable set cannot occupy all the grid squares covered by another playable set having the same set configuration;

the step of counting the total quantity of playable sets placed on the grid further comprises counting the total quantity of playable sets placed on the grid and the total number of catch squares covered by each playable set; and the step of determining winning side bets further comprises designating each bet as a winning side bet if the prediction count of the side bet matches the quantity of playable sets placed on the grid and the quantity of the catch squares covered by said playable sets.

* * * * *